US006449445B1

(12) United States Patent
Nakamori et al.

(10) Patent No.: US 6,449,445 B1
(45) Date of Patent: Sep. 10, 2002

(54) IMAGE HEATING APPARATUS WITH TIME CONSTANT SETTING MEANS

(75) Inventors: Tomohiro Nakamori, Shizuoka-ken; Kei Sato, Numazu, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/325,559

(22) Filed: Jun. 4, 1999

(30) Foreign Application Priority Data

Jun. 10, 1998 (JP) ..... 10-176577

(51) Int. Cl.[7] ..... G03G 15/20
(52) U.S. Cl. ..... 399/69; 399/70
(58) Field of Search ..... 399/67, 69, 70, 399/320, 328, 329, 330, 334; 219/216

(56) References Cited

U.S. PATENT DOCUMENTS 4,937,600 A 6/1990 Hirabayashi et al. .... 346/160.1
5,225,874 A * 7/1993 Koh et al. ..... 399/69
5,303,015 A 4/1994 Sato
5,334,817 A 8/1994 Nakamori et al.
5,436,712 A * 7/1995 Wayman et al. ..... 399/328
5,819,134 A 10/1998 Sato et al.

FOREIGN PATENT DOCUMENTS

JP 1-46782 * 2/1989
JP 1-81976 * 3/1989
JP 02-059782 2/1990
JP 5-307338 * 11/1993

* cited by examiner

*Primary Examiner*—Quana M. Grainger
(74) *Attorney, Agent, or Firm*—Ftizpatrick, Cella, Harper & Scinto

(57) ABSTRACT

An image heating apparatus including a heater, a power supply for supplying electric power to the heater, and a time constant setting circuit for setting a time constant when the power supply starts the supply of electric power to the heater, the time constant setting means setting the time constant in conformity with the shut-off time of the supply of electric power to the heater.

3 Claims, 9 Drawing Sheets

IMAGE HEATING APPARATUS WITH TIME CONSTANT SETTING MEANS

BACKGROUND OF THE INVENTION

1. Field of the Invention

This invention relates to an image heating apparatus for use as a fixing device of a copying apparatus or a printer.

2. Related Background Art

Generally, an image heating apparatus of this kind has a heater supplied with electric power from a commercially available power source and generating heat, and is temperature-controlled so that a temperature of this heater or a temperature of a fixing roller heated by this heater may maintain a predetermined level.

However, when there is present an illuminator or the like supplied with electric power from the same plug receptacle as the heating apparatus, there has been the possibility of a flicker phenomenon of the illuminator or the like flickering being caused by a sudden increase or decrease in voltage by the changeover for the conduction or shut-off from the commercially available power source to heating means, depending on the impedance of the power source.

SUMMARY OF THE INVENTION

The present invention has been made in view of the above-noted problem and an object thereof is to provide an image heating apparatus which can suppress the flicker occurring to an illuminator or the like.

Another object of the present invention is to provide an image heating apparatus having:

a heater;

power supply means for supplying electric power to the heater; and time constant setting means for setting a time constant when the power supply means starts the supply of the electric power to the heater, the time constant setting means setting the time constant in conformity with a shut-off time of the supply of the electric power to the heater.

Still another object of the present invention is to provide an image heating apparatus having:

a heater; and power supply control means for controlling electric power supply to the heater;

wherein the power supply control means shuts off the electric power supply from an electric power supplying state so that an applied voltage to the heater may drop at a predetermined time constant.

Yet still another object of the present invention is to provide an image heating apparatus having:

a heater; and power supply control means for controlling electric power supply to the heater;

wherein the power supply control means starts the electric power supply so that an applied voltage to the heater may rise at a predetermined time constant, and shuts off the electric power supply from the electric power supplying state so that the applied voltage may drop at a predetermined time constant.

A further object of the present invention is to provide an image heating apparatus having:

a heater;

power supply means for supplying electric power to the heater; and time constant setting means for setting a time constant when the power supply means starts the supply of the electric power to the heater, the time constant setting means setting a greater time constant during a standby operation than during an image heating operation.

Further objects of the present invention will become apparent from the following detailed description when read with reference to the accompanying drawings.

DESCRIPTION OF THE PREFERRED EMBODIMENTS

Some embodiments of the present invention will hereinafter be described with reference to FIGS. 1 to 5, 6A and 6B, 7, 8A and 8B.

First Embodiment

Figure 1:
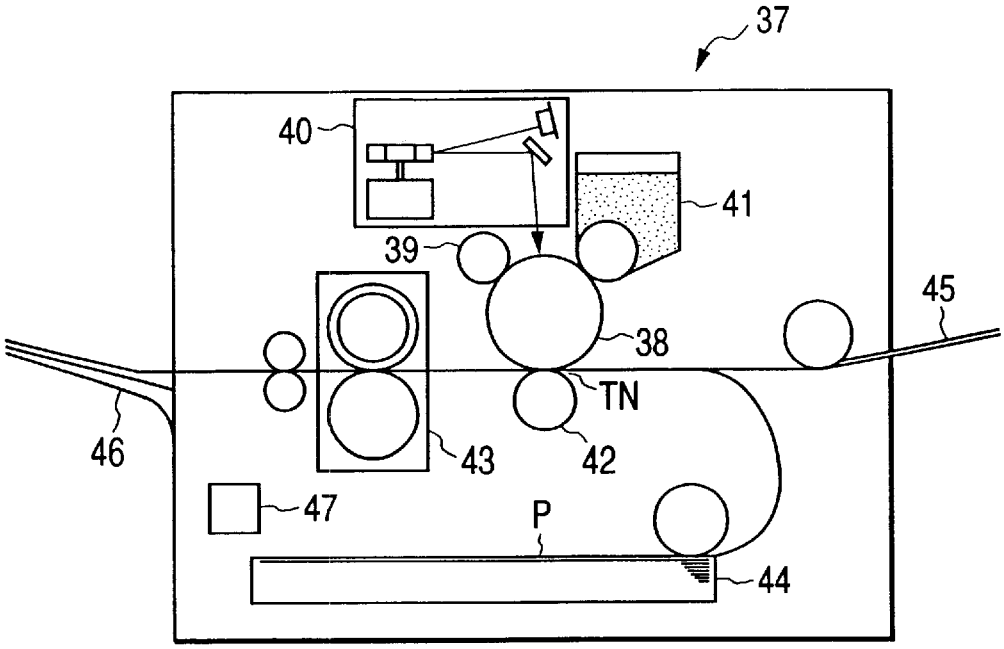
FIG. 1 is a typical cross-sectional view schematically showing a construction of a laser beam printer which is an example of an image forming apparatus using a first embodiment of the present invention.

FIG. 1 is a typical cross-sectional view schematically showing the construction of a laser beam printer 37 (hereinafter referred to as the printer 37) which is an example of an image forming apparatus provided with an image heating apparatus of the present invention.

The printer 37, as shown in FIG. 1, is provided with a drum-shaped photosensitive member 38 on the outer peripheral surface of which an electrostatic latent image is formed, a roller-shaped charging member 39 for charging the outer peripheral surface of the photosensitive member 38 to prescribed potential, a laser scanner unit 40 for forming an electrostatic latent image on said outer peripheral surface charged to the prescribed potential, by exposure, a developing device 41 for making the electrostatic latent image into a visible image by a developer, a roller-shaped transferring member 42 for transferring the visible image (visualized image) formed on said outer peripheral surface to recording paper P which is a sheet of recording medium, and a fixing device 43 which is an image heating apparatus.

In the printer 37, the laser scanner unit 40 first effects exposure on the outer peripheral surface of the photosensitive member 38 charged to the prescribed potential by the charging member 39, whereby an electrostatic latent image conforming to image information given from the outside to the printer 37 is formed on said outer peripheral surface.

Next, the electrostatic latent image formed on the outer peripheral surface of the photosensitive member 38 is given a developer from the developing device 41, whereby it is visualized into a visible image.

On the other hand, the recording paper P on which image information conforming to the given image information is recorded is fed at predetermined timing or the like from a cassette 45 removably supported on the body of the printer 37 or a multipaper tray 44 disposed on one side of the printer 37 to a transfer nip portion TN formed between the photosensitive member 38 and the transferring member 42.

Consequently, the visualized image formed and borne on the outer peripheral surface of the photosensitive member 38 is transferred to the recording paper P having arrived at the transfer nip portion TN by electrical interaction from the transferring member 42.

Subsequently, the recording paper P bearing the visualized image in its unfixed state on one surface thereof (hereinafter the visualized image in its unfixed state will be referred to as the unfixed image) is supplied with heat and given pressure at the fixing device 43, whereby the unfixed image is melted and fixed, whereby an image conforming to the given image information is recorded on the recording paper P, and the recording paper P now having the image formed thereon is discharged onto a paper discharging tray 46 disposed on the other side of the body of the printer 37.

Figure 2:
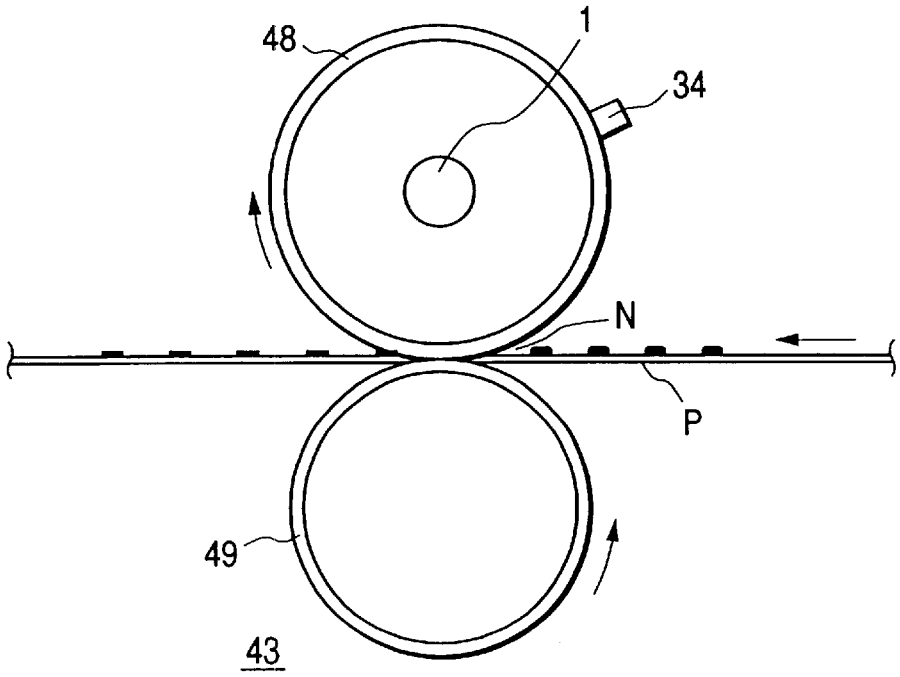
FIG. 2 is a typical cross-sectional view schematically showing a construction of a fixing device in the first embodiment.
Figure 3:
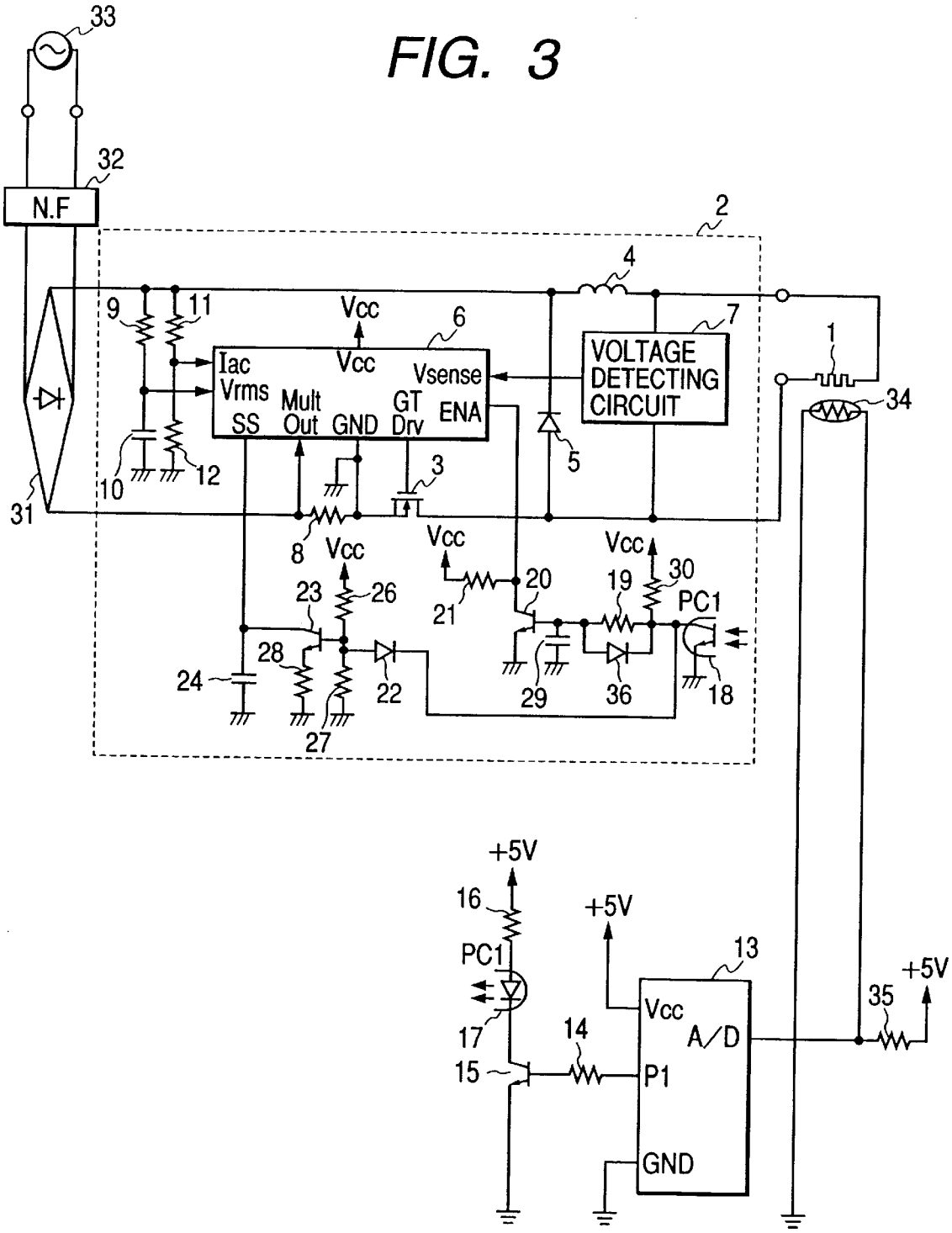
FIG. 3 is a block diagram showing signal routes of the fixing device and a temperature control system in the first embodiment.

FIG. 2 is a typical cross-sectional view schematically showing the construction of the fixing device 43 in the present embodiment, and FIG. 3 is a block diagram showing the signal routes of the fixing device and a temperature control system in the present embodiment.

As shown in FIG. 2, the fixing device 43 has a heater which is heating means receiving electric power from a commercially available power source and generating heat, a thermistor 34 which is a temperature detecting member for detecting the temperature of the heater 1, a fixing roller 48 which is a fixing member conducting the heat from the heater 1, and a pressing roller 49 which is a pressing member urged against the fixing roller 48.

A control portion 47 mounted on the body of the printer 37 provided with the fixing device 43 is provided with a constant voltage output circuit 2 which is adjusting means for changing over to the conduction or shut-off from the commercially available power source to the heater 1 with a time constant, and an MPU 13 which is control means for controlling the changeover of the constant voltage output circuit 2 in conformity with the temperature detected by the thermistor 34.

The fixing device 43 is adapted to pass the recording paper P bearing the unfixed image thereon to the nip portion N provided by the pressure contact between the fixing roller 48 and the pressing roller 49 to thereby fix the unfixed image on the recording paper P by the heat of the heater 1 through the fixing roller 48.

The constant voltage output circuit 2 has a voltage dropping type DC-DC converter comprising a chopping FET 3, an inductor 4 and a diode 5 for a snubber.

The constant voltage output circuit 2 is designed such that a control IC 6 (in the present embodiment, UC 3854 produced by UNITRODE Inc. is used) for detecting an output voltage and an output current to the heater and an input root mean square value voltage and an input voltage waveform from the commercially available power source detects the above-mentioned output voltage by a voltage detecting circuit 7, detects the above-mentioned output current by a current detecting resistor, detects the above-mentioned input root mean square value by a resistor 9 and a capacitor 10, and detects the input voltage waveform by a resistor 11 and a resistor 12, and is adapted to control the ON duty of the chopping FET 3 being turned on/off by about 100 kHz so that the output voltage may become constant and the output current waveform may become a waveform similar to the input current waveform.

The MPU 13 is provided with a timer, a ROM, a RAM, input and output ports (all not shown), etc., and a digital output port P1 provided in the MPU 13 is connected to the base of a transistor 15 through a resistor 14, and a signal from the digital output port P1 is made HIGH, whereby the transistor 15 is turned on, a photodiode 17 connected to a +5 V power source through a resistor 16 is turned on, a phototransistor 18 is turned on and a transistor 20 is turned off through a resistor 19, whereby the voltage of a voltage source Vcc is inputted to the enable terminal ENA of the control IC 6 through a resistor 21 to thereby operate the control IC 6 so as to control the constant voltage output.

At the same time, a transistor 23 is also turned off through a diode 22, and a capacitor 24 connected to a soft start terminal SS provided in the control IC 6 is charged by a constant current power source in the control IC 6, and the potential of the soft start terminal SS rises in the fashion of a primary function, whereby the output voltage of the constant voltage output circuit 2 also rises with a predetermined time constant.

On the other hand, when the output of the constant voltage output circuit 2 is put off, the charge of the capacitor 24 is discharged by a constant current discharging circuit comprised of a resistor 26, a resistor 27 and a resistor 28 and therefore, the potential of the soft start terminal SS drops in the fashion of a primary function, and the output voltage of the constant voltage output circuit also drops with a predetermined time constant.

A capacitor 29 and a diode 36 connected to the base of the transistor 20 are designed such that when the phototransistor 18 of a photocoupler PC1 is turned off, the transistor 20 for enable control is turned off with a predetermined delay time relative to the transistor 23 for soft start control, and a resistor 30 is a pull-up resistor for turning on the transistor 20 and the transistor 23.

Also, the constant voltage output circuit 2 is connected to the commercially available power source 33 through a diode bridge 31 and a noise filter 32, and the MPU 13 detects the temperature of the heater by the thermistor 34 and the resistor 35, and controls the ON/OFF of the constant voltage output circuit 2 in conformity with this detected temperature, thereby adjusting the temperature of the heater so as to become a target temperature.

Figure 4:
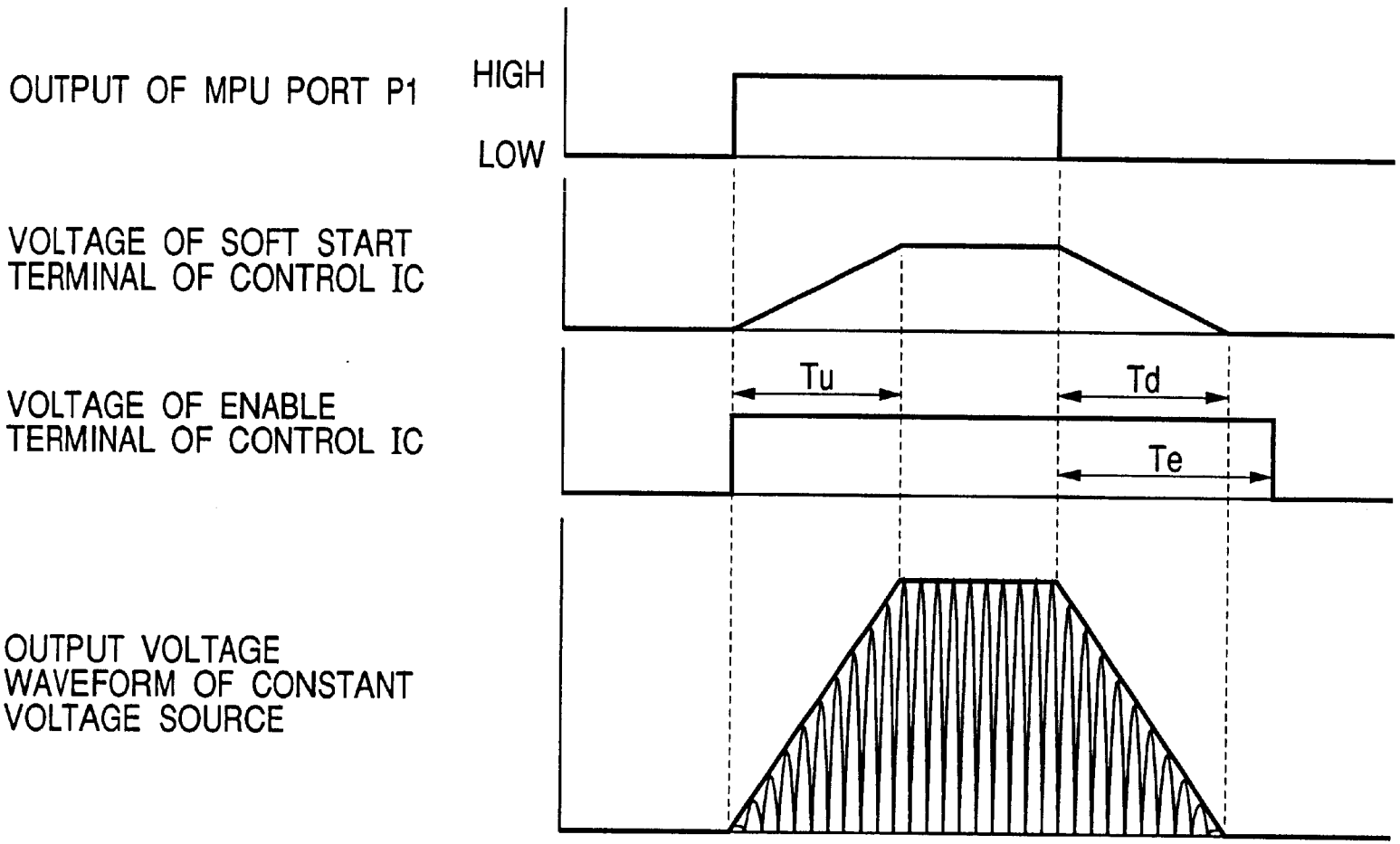
FIG. 4 is a timing chart showing a control of heating means in the first embodiment.

The control during the ON/OFF of the heater will now be described on the basis of a timing chart shown in FIG. 4.

The MPU 13 outputs a HIGH signal from the output port P1 to the constant voltage output circuit 2, whereby the voltage of the soft start terminal of the control IC 6 linearly rises with a time constant Tu.

On the other hand, the MPU 13 outputs a LOW signal from the output port P1 to the constant voltage output circuit 2, whereby the voltage of the soft start terminal linearly drops with a time constant Td, whereafter in a time Te, the enable terminal becomes LOW and the control IC 6 stops.

As described above, when changeover is effected from conduction to shut-off or from shut-off to conduction from the commercially available power source to the heater, the voltage of the above-described electric power supply is put ON/OFF in the fashion of a primary function wish a predetermined time constant, whereby a sudden increase or decrease in the electric current by the changeover of the electric power supply can be alleviated and flicker can be prevented.

With a such plunge current occurring when the heater is turned on taken into account, the rising time constant Tu during ON is made longer than the time constant Td during OFF (Tu>Td), whereby a sudden increase or decrease in the electric current from the commercially available power source can be prevented more effectively.

Second Embodiment

A second embodiment of the present invention will now be described with reference to FIGS. 5, 6A, 6B and 7.

In the construction of a fixing device in the present embodiment, portions similar to those in the first embodiment are given similar reference characters and need not be described.

Figure 5:
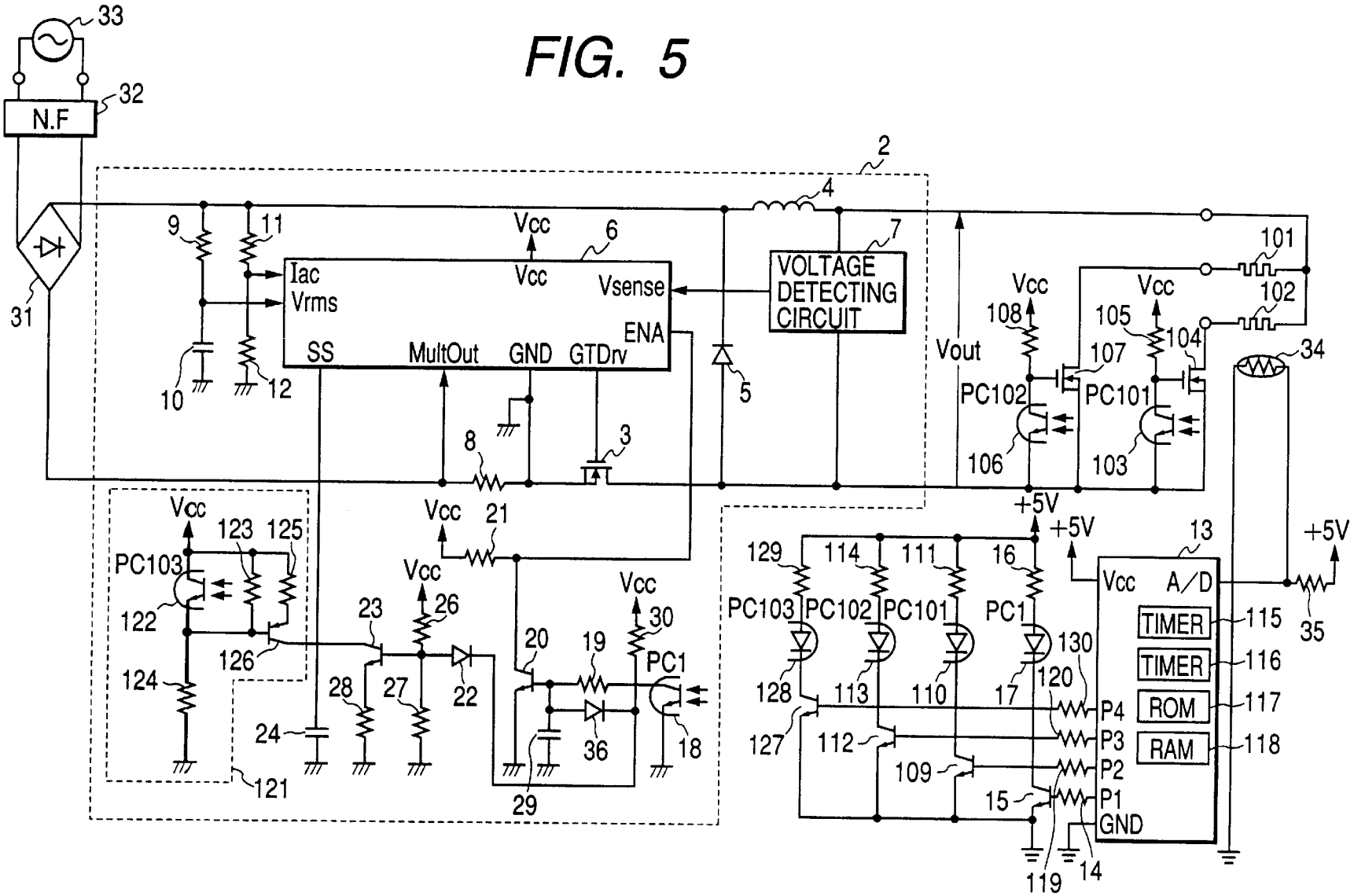
FIG. 5 is a circuit diagram showing a construction of a control system of a fixing device in a second embodiment of the present invention.

FIG. 5 is a circuit diagram showing the construction of the fixing device in the present embodiment.

The fixing device in the present embodiment, as shown in FIG. 5, has a halogen heater 101 (hereinafter referred to as the heater 101) and a halogen heater 102 (hereinafter referred to as the heater 102) which are two heating means, and the heater 101 is connected to the constant voltage output circuit 2 and an FET 107 which is a switching element, and the heater 102 is connected to the constant voltage output circuit 2 and an FET 104 which is a switching element.

The heater 101 is connected to the constant voltage output circuit 2 by the FET 107 becoming conductive, whereby electric power supply is effected, and heater 102 is connected to the constant voltage output circuit 2 by the FET 104 becoming conductive, whereby electric power supply is effected.

The phototransistor 103 of a photocoupler PC 101, the phototransistor 106 of a photocoupler PC 102, a pull-up resistor 105 and a pull-up resistor 108 are connected to the gates of the FET 104 and the FET 107, respectively.

The anode of the photodiode 110 of the photocoupler PC 101 and the anode of the photodiode 113 of the photocoupler PC 102 are connected to +5 V power source through a resistor 111 and a resistor 114, respectively, and the cathodes thereof are connected to the collectors of the transistors 109 and 112, respectively.

On the other hand, the bases of the transistors 109 and 112 are connected to the digital output port P2 and output port P3, respectively, of an MPU 13 which is a microprocessor through a resistor 119 and a resistor 120, respectively, and the MPU 13 has a timer 115, a timer 116, a ROM 117, a RAM 118, input and output ports (not shown), etc.

The output ports P2 and P3 of the MPU 13 are made LOW, whereby the transistor 109 and the transistor 112 are turned off, and the photodiode 110 and the photodiode 113 are turned off.

Thereby, the gate potential of the FET 104 and the FET 107 rises, and the FET 104 and the FET 107 become conductive, and the heater 101 and the heater 102 are connected to the constant voltage output circuit 2.

When the constant voltage output circuit 2 is actually operated, the heater 101 and the heater 102 are turned on, and these heaters are connected to the constant voltage output circuit 2 when signals outputted from the output ports P2 and P3 of the MPU 13 which effects the connection of the heaters 101 and 102 to the constant voltage output circuit 2 (hereinafter referred to as the connection signals of the heater 101 and the heater 102) are ON.

Also, a constant voltage is outputted when a signal outputted from the output port P1 of the MPU 13 which controls the enable terminal ENA of a control IC 6 (hereinafter referred to as the constant voltage output control signal) is ON, and the respective heaters are turned on only when all of the constant voltage output control signal and the heater connection signals are ON.

Also, a constant current source 121 is provided in parallel to the soft start terminal SS of the control IC 6 to change over the time constant for the rising of the constant voltage output, and the control of this constant current source 121 is effected by the output port P4 of the MPU 13, and when the output port P4 is HIGH, the photodiode 128 of the photocoupler PC 103 is turned off and a phototransistor 122 is also turned off and a transistor 126 is turned on.

A constant current determined by a voltage divided by a resistor 123 and a resistor 124 and a resistor 125 charges a capacitor 24 with a supplied current from the soft stat terminal SS of the control IC 6, whereby it becomes possible to change over the time constant for the rising to two stages Tu1 and Tu2 (Tu1<Tu2).

The case of the time constant Tu1 for the rising is called a short mode, and the case of the time constant Tu2 for the rising is called a long mode, and the short mode is brought about when the signal of the output port P4 of the MPU 13 which changes over the time constant for the rising (hereinafter referred to as the time-constant-changeover-signal) is ON.

On the other hand, during the falling, the time constant changeover signal is put off and the constant current source 121 is not operated, and is always made to fall with a time constant Td.

Figure 6:
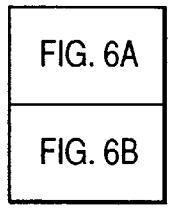
FIG. 6, comprised of FIGS. 6A and 6B, is a flowchart showing a processing procedure of a control of heating means in the second embodiment.
Figure 6A:
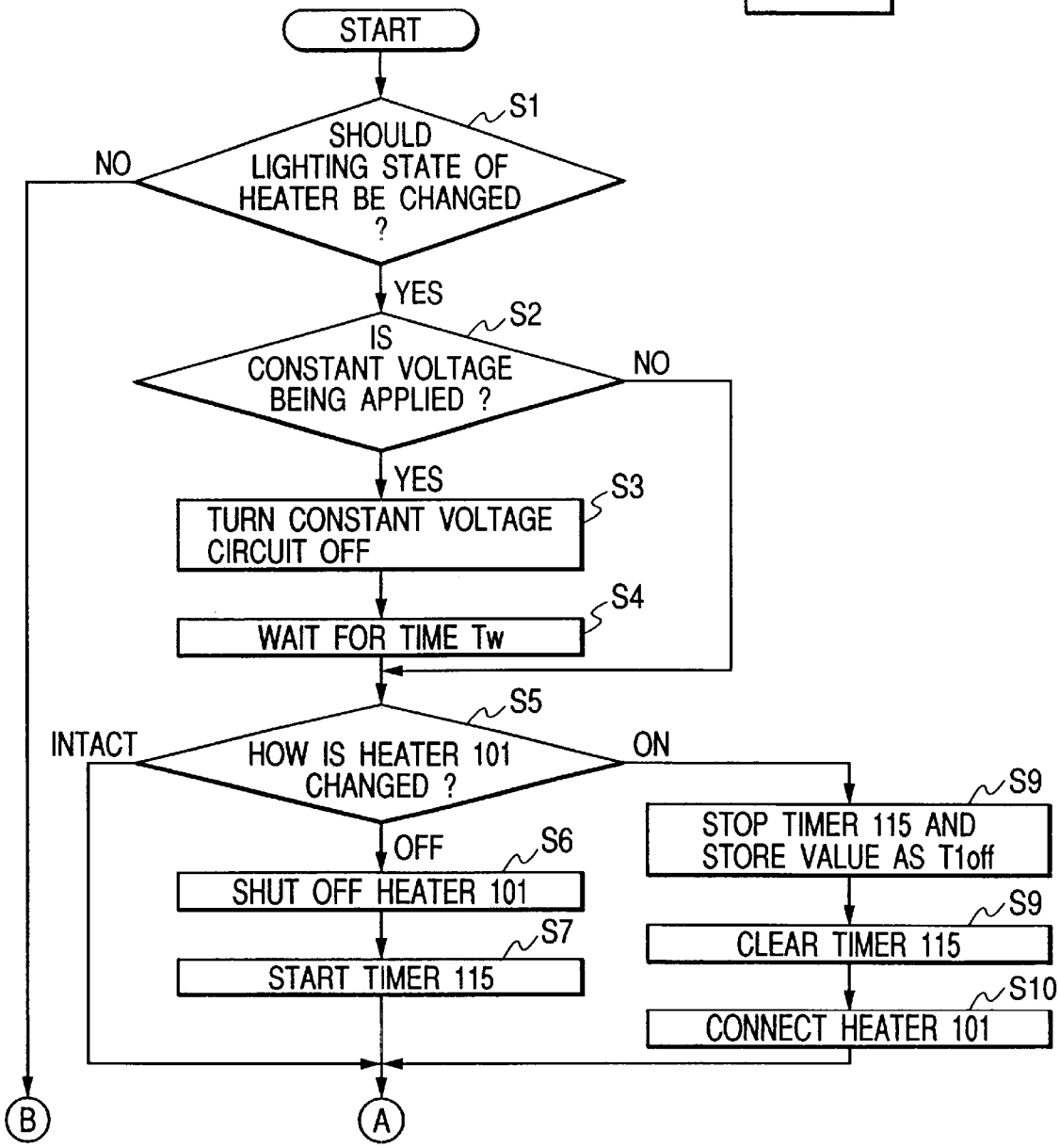
Figure 6B:
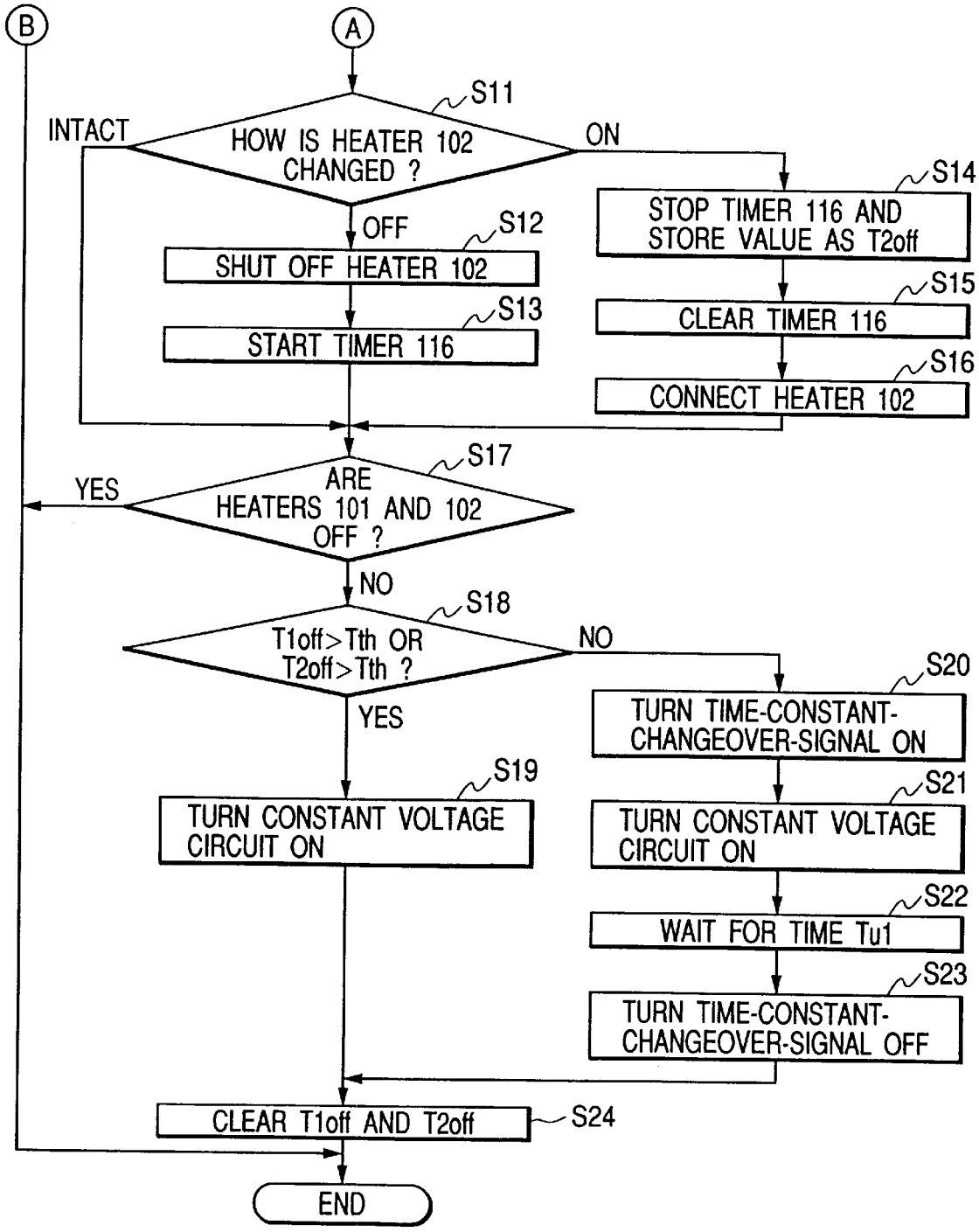

FIGS. 6A and 6B are flowcharts showing the processing procedure of heater control effected by the MPU 13.

First, whether the lighting state of the heater 101 and the heater 102 should be changed is judged by the temperature of the heaters detected by the thermistor 34 (S1), and when it should be changed, whether the constant voltage output circuit 2 is outputting a constant voltage (the constant voltage output control signal is ON) is confirmed (S2).

When the constant voltage output circuit is outputting a constant voltage and the heaters are turned on, the constant voltage output circuit is turned off (step S3), and waits for a time Tw until its output voltage is completely put off (S4), and on the other hand, if the constant voltage output circuit is not outputting the constant voltage, shift is made to a step S5.

Next, how the state of the heater 101 is changed is discriminated (S5), and first, when the heater 101 is to be changed from ON to OFF, the connection between the constant voltage output circuit 2 and the heater 101 is shut off (the heater 101 connection signal is OFF) (step S6), and the timer 115 for measuring the OFF time of the heater 101 is started (S7).

On the other hand, when the heater 101 is to be changed from OFF to ON, the timer 115 which has measured the OFF time of the heater 101 is stopped so that a RAM 118 stores the value as T1off (step S8), and the timer 115 is cleared (step S9), and the heater 101 is connected with the constant voltage output circuit 2 (the heater connection signal is ON) (step S10).

When the state of the heater 101 is not changed, nothing is done and shift is made to S11.

Next, processing (S11 to S16) similar to the above-described processing (S5 to S10) of the heater 101 is effected on the heater 102.

Then, whether the connection signals of the heater 101 and the heater 102 are both OFF is discriminated (S17), and if both are OFF, the program ends, and if at least one of the heaters are connected, whether T1off or T2off stored in the RAM 118 is greater than a threshold value Tth stored in the ROM 117 is first discriminated (S18).

If T1off or T2off stored in the RAM 118 is greater than the threshold value Tth stored in the ROM 117, the mode is judged to be the long mode and the constant voltage output circuit is turned on (S19), and in any other case, the mode is judged to be the short mode and the-time-constant-changeover-signal is turned on (S20) and the constant voltage output is turned on (S21).

After waiting for the time constant Tu1 during the rising (S22), the time-constant-changeover-signal is turned off (S23), and T1off and T2off are cleared (S24).

Figure 7:
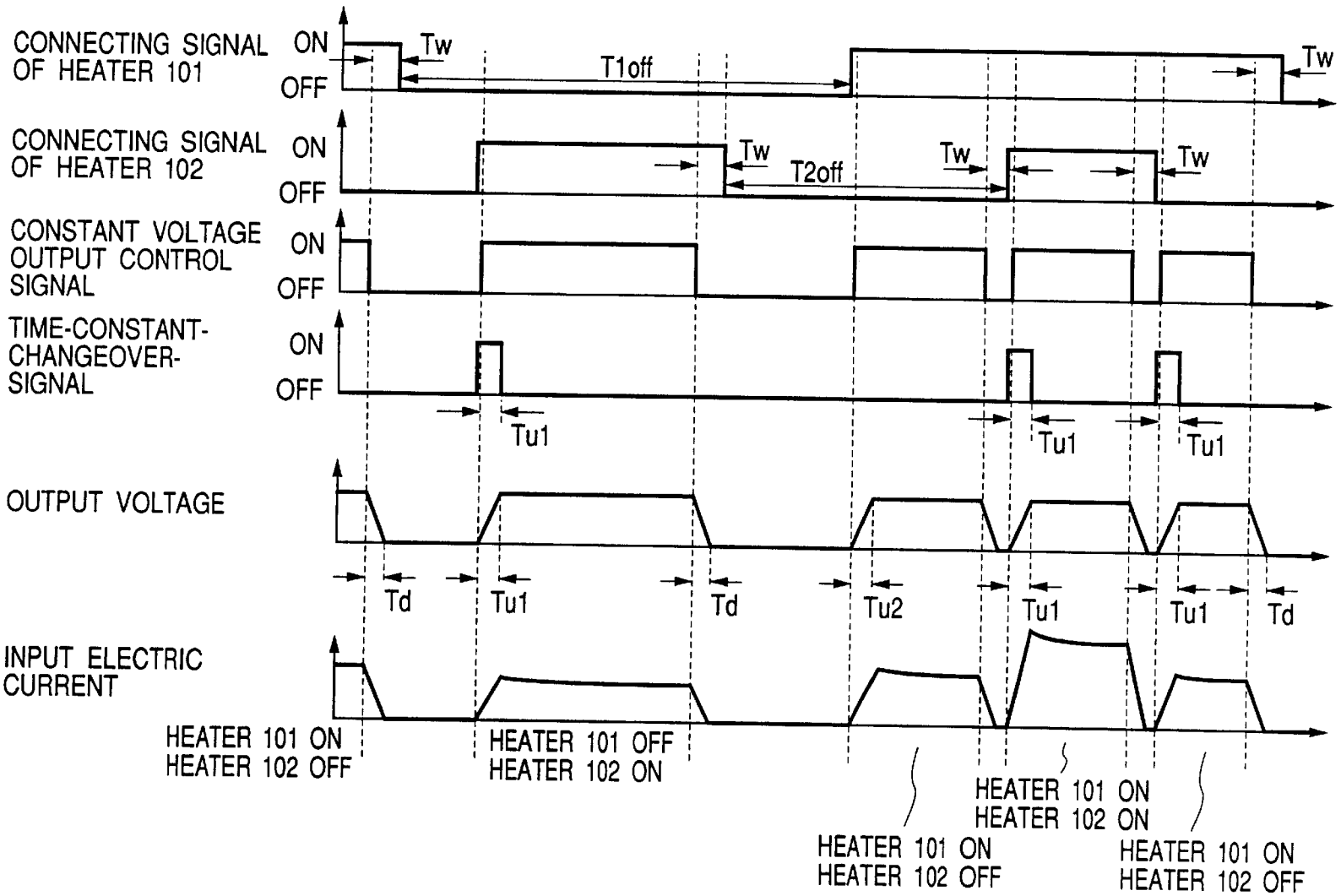
FIG. 7 is a timing chart showing control signal waveforms in the control of the heating means in the second embodiment.

FIG. 7 is a timing chart showing the waveforms of the control signals during the ON/OFF of the heaters.

FIG. 7 shows the connection signals of the heater 101 and the heater 102, the output control signal of the constant voltage output circuit 2, the time-constant-changeover-signal, the output voltage Vout of the constant voltage output circuit 2 and the input current from the commercially available power source 33 when the heater 101 is turned off from a state in which the heater 101 is ON and the heater 102 is OFF, and subsequently the heater 102 is turned on, and then is turned off, and the heater 102 is turned on from a state in which the heater 101 is ON, and subsequently the heater 102 is turned off and the heater 101 is turned off.

When the heater 101 is ON, the connection signal of the heater 101 and the constant voltage output control signal are ON, and a constant voltage is outputted from the constant voltage output circuit 2, and the input current also is constant, and the heater 102 is OFF and therefore, the timer 116 for measuring the OFF time of the heater 102 is operating.

When the heater 101 is to be turned off, the constant voltage output control signal is first turned off, whereby the output voltage falls with a predetermined time constant Td by the falling function, and after a time Tw from a tme when the constant voltage output control signal is turned off (Tw>Td), the connection signal of the heater 101 is also turned off and the timer 115 is started and begins to measure the OFF time of the heater 101.

Next, when the heater 102 is to be turned on, the timer 116 which has so far operated is first stopped because the constant voltage is not outputted, and the OFF time of the heater 102 is found, whereafter the connection signal of the heater 102 is turned on, and the mode is set to the long mode when that connection signal is long as compared with the threshold value Tth stored in the ROM 117, and the mode is set to the short mode when that connection signal is short as compared with the threshold value Tth. (In the present embodiment, the connection signal is shorter than the threshold value Tth and the mode is set to the short mode.)

Then, the time-constant-changeover-signal is turned on and the constant voltage output control signal is turned on, whereby the constant voltage output circuit 2 begins to operate, and the output voltage rises with the time constant Tu1. The time-constant-changeover-signal and the constant current source 121 operated thereby can be ON only during the rising and therefore, at a point of time whereat the time Tu1 has passed after the constant voltage output control signal has been turned on, the time-constant-changeover-signal is turned off and after a predetermined time from that time, the heater 102 is turned off, and as in the case of the heater 101, the constant voltage output control signal is first turned off and the output voltage is made to fall with the predetermined time constant Td.

After the time Tw from a time when the constant voltage output control signal has been turned off, the connection signal of the heater 102 is also turned off, and the timer 116 is started and begins to measure the OFF time of the heater 102.

Next, the heater 101 is again turned on, and as in the above-described case, the timer 115 is stopped to thereby find the OFF time T1off of the heater 101, and T1off is compared with the threshold value Tth, and since in the present embodiment, T1off is longer than the threshold value Tth, the mode is the long mode, and the constant voltage output is turned on with the time-constant-changeover-signal remaining OFF, and is made to rise with the time constant Tu2.

Subsequently, the heater 102 is turned on, but since the heater 101 is ON, the constant voltage output is once turned off to thereby make the output voltage fall with the time constant Td. Here, the connection signal of the heater 101 remains ON.

After the time Tw from a time when the constant voltage output control signal has been turned off, the timer 116 is stopped and the connection signal of the heater 102 is turned on. In the present embodiment, it is to be understood that the OFF time T2off of the heater 102 is shorter than the threshold value Tth. Therefore, the mode becomes the short mode, and the time-constant-changeover-signal is turned on and the constant voltage output control is started and is made to rise with the time constant Tu1, and at this time, the connection signal of the heater 101 also is ON and therefore, the both heaters are ON and the input current becomes much.

Subsequently, the heater 102 is turned off, but since the heater 101 is ON, the constant voltage output is once turned off and is made to fall with the time constant Td, and after the time Tw from that time, the connection signal of the heater 102 is turned off and simultaneously therewith, the timer 116 is started. The constant voltage output is then turned on, but the connection signal of the heater 101 remains ON and T1off is 0.

Therefore, the output voltage is made to rise in the short mode, and after a predetermined time from that time, the heater 101 is turned off as hitherto described.

As described above, provision is made of the means for changing over the time constant for the rising to thereby change over the time constant for the rising in conformity with the length of the time for which the heaters connected to the constant voltage output circuit are OFF, whereby even when the time for which the heaters are off is long and the resistance values of the heater have dropped, the time constant for the rising is lengthened to thereby suppress the overshooting of the electric current when the heaters are ON, and a sudden increase in the electric current can be prevented more effectively.

Consequently, the time constant for the rising from the commercially available power source to the heating means is changed over in conformity with the length of the time for which the heating means has been disconnected from the commercially available power source, whereby when use is made of such heat generating means as a halogen heater of which the resistance value is changed by the temperature of the heat generating portion thereof and in which a plunge current is created as the OFF time becomes longer, a sudden increase or decrease in the current of the commercially available power source can be alleviated more effectively.

While the present embodiment has been shown with respect to a case where two heaters are used, the present invention can be equally applied to a case where one or three or more heaters are used and further, the time constants for the rising are not limited to two kinds, but changeover may be done with three or more kinds of time constants.

Third Embodiment

A third embodiment of the present invention will now be described with reference to FIGS. 8A and 8B. In this embodiment, portions similar to those in the second embodiment are given the same reference characters and need not be described.

Figure 8:
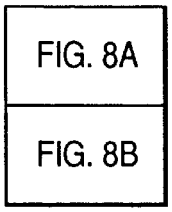
FIG. 8, comprised of FIGS. 8A and 8B, is a flowchart showing a processing procedure of a control of a heater in a third embodiment of the present invention.
Figure 8A:
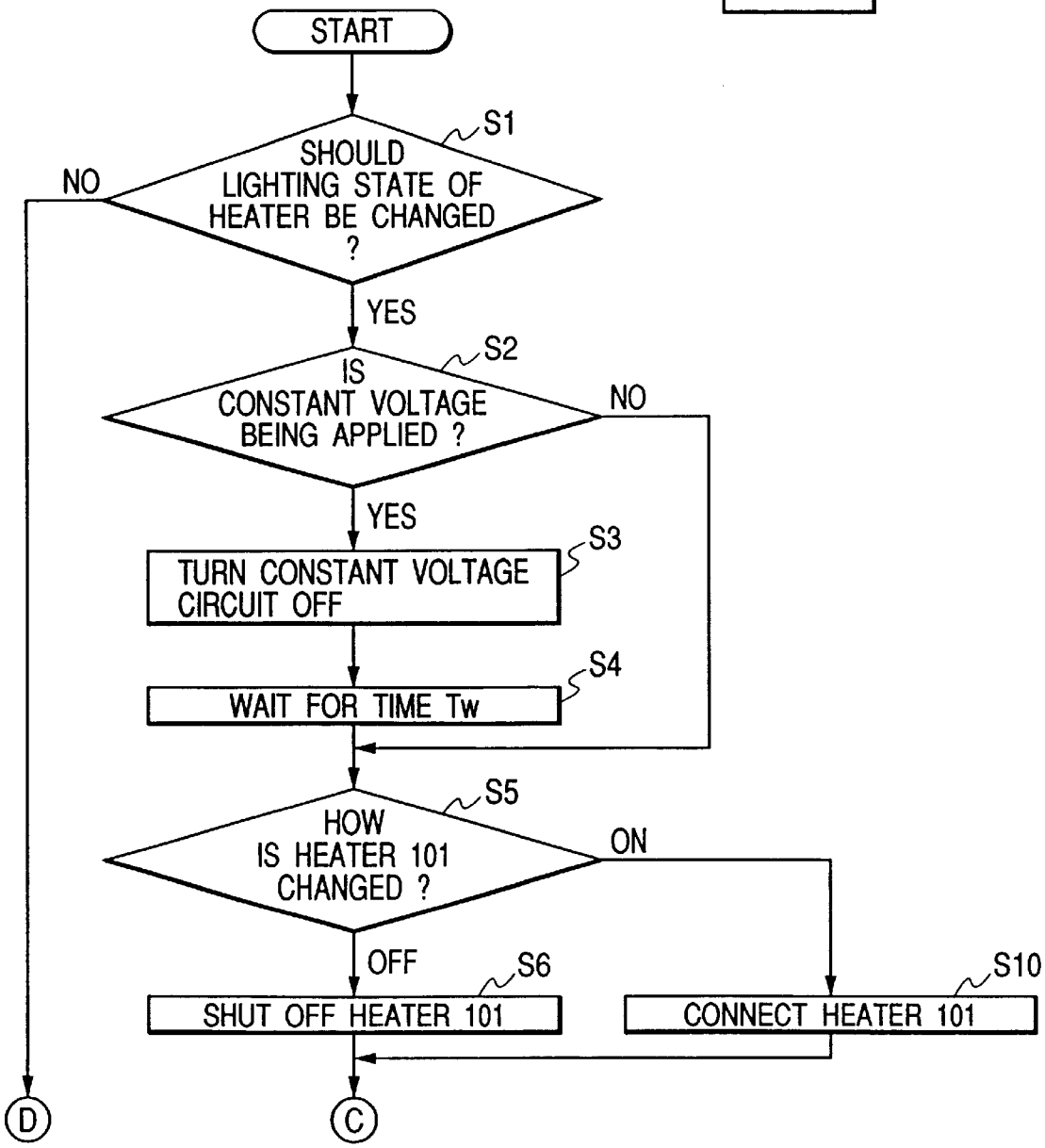
Figure 8B:
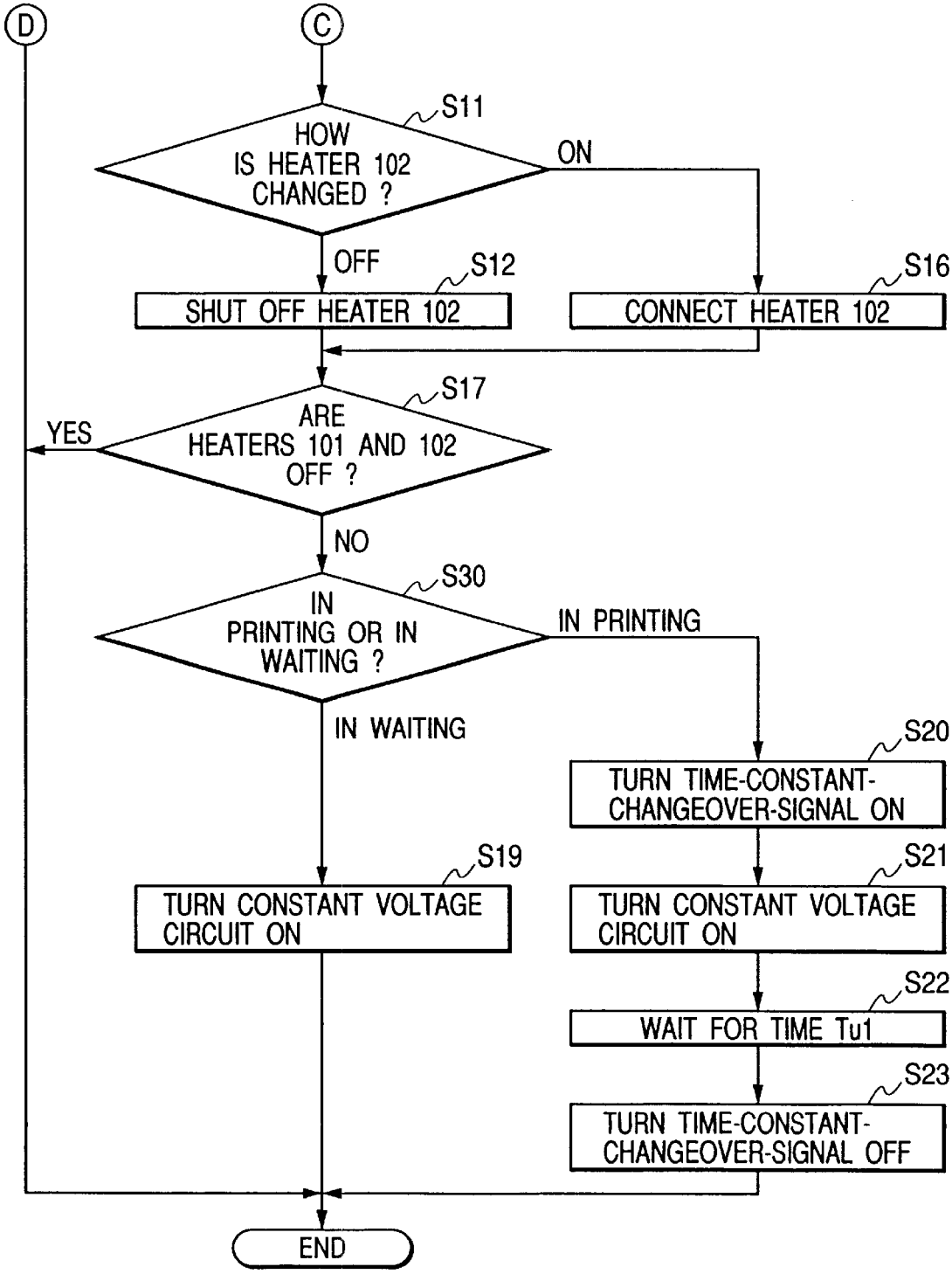

FIGS. 8A and 8B are flowcharts showing the processing procedure of the heater control in the present embodiment.

The difference of the present embodiment from the second embodiment is that at S17, wherein the connection signals of the heater 101 and the heater 102 are both OFF is discriminated, whereafter whether the image forming apparatus is in a printing operation wherein the heater turn-on frequency is high and the turn-on interval is short or in waiting wherein the heater turn-on frequency is low and the turn-on interval is long is discriminated (S30), and if it is in waiting, the constant voltage output circuit is turned on while the mode remains being the long mode (S19), and if it is in printing, the time-constant-changeover-signal is turned on to bring about the short mode (S20), and the constant voltage output circuit is turned on (S21). After waiting for the time constant Tu1 for the rising (S22), the time-constant-changeover-signal is turned off (S23).

As described above, provision is made of the means for changing over the time constant for the rising to thereby change over the time constant for the rising in conformity with whether the image forming apparatus is in printing or in waiting, whereby even when the apparatus is in waiting wherein the time for which the heaters are OFF is long and the resistance values of the heaters have dropped, the time constant for the rising is lengthened to thereby suppress the overshooting of the electric current when the heaters are ON, and a sudden increase in the electric current can be prevented more effectively.

Consequently, the time constant for the rising is changed over in conformity with whether the image forming apparatus is in printing or in waiting, whereby when use is made of such heat generating means as a halogen heater of which the resistance value is changed by the temperature of the heat generating portion thereof and in which as in waiting, a plunge current is created as the OFF time becomes longer, a sudden increase or decrease in the current of the commercially available power source is alleviated more effectively.

While the present embodiment has been shown with respect to a case where two heaters are used, the present invention can be equally applied to a case where one or three or more heaters are used and further, the time constants for the rising are not limited to two kinds, but changeover may be done with three or more kinds of time constants.

What is claimed is:

1. An image heating apparatus comprising:

a heater;

power supply means for supplying electric power to said heater; and time constant setting means for setting a time constant when said power supply means starts a supply of electric power to said heater, said time constant setting means setting the time constant in conformity with a shut-off time of the supply of electric power to said heater.

2. An image heating apparatus according to claim 1, wherein said time constant setting means sets a time constant when the shut-off time of the supply of electric power is long to a value greater than a time constant when the shut-off time of the supply of electric power is short.

3. An image heating apparatus comprising:

a heater;

power supply means for supplying electric power to said heater; and time constant setting means for setting variably a time constant for a rising of electric power supply on starting the electric power supply to said heater with said power supply means, wherein said time constant setting means is setting the time constant greater during a standby operation than during an image heating operation.

* * * * *

UNITED STATES PATENT AND TRADEMARK OFFICE

CERTIFICATE OF CORRECTION

PATENT NO. : 6,449,445 B1
DATED : September 10, 2002
INVENTOR(S) : Tomohiro Nakamori et al.

It is certified that error appears in the above-identified patent and that said Letters Patent is hereby corrected as shown below:

Column 7,
Line 46, “tme” should read -- time --.

Signed and Sealed this

Eighteenth Day of February, 2003

JAMES E. ROGAN
*Director of the United States Patent and Trademark Office*